United States Patent [19]

Okada et al.

[11] Patent Number: 4,971,535

[45] Date of Patent: Nov. 20, 1990

[54] TANDEM ROTARY PUMP WITH PRESSURE CHAMBER BETWEEN TWO INTERMEDIATE SIDE PLATES

[75] Inventors: Takahiko Okada, Chiryu; Hidetoshi Fujiwara, Aichi; Norihisa Katafuchi, Okazaki, all of Japan

[73] Assignee: Toyoda Koki Kabushiki Kaisha, Kariya, Japan

[21] Appl. No.: 318,258

[22] Filed: Mar. 3, 1989

[30] Foreign Application Priority Data

Mar. 4, 1988 [JP] Japan ..... 63-29586[U]

[51] Int. Cl.[5] ..... F04C 11/00

[52] U.S. Cl. ..... 418/133; 418/212

[58] Field of Search ..... 418/212, 132, 133

[56] References Cited

U.S. PATENT DOCUMENTS

| | | | |
|---|---|---|---|
| 3,104,530 | 9/1963 | Teichert | 51/385 |
| 3,645,654 | 2/1972 | Niemiec | 418/133 |
| 3,697,201 | 10/1972 | Eickmann | 418/133 |
| 4,347,047 | 8/1982 | Shiozawa et al. | 417/310 |
| 4,415,319 | 11/1983 | Masuda | 418/212 |

FOREIGN PATENT DOCUMENTS

| | | | |
|---|---|---|---|
| 978190 | 12/1948 | France | 418/212 |

*Primary Examiner*—John J. Vrablik
*Assistant Examiner*—David L. Cavanaugh
*Attorney, Agent, or Firm*—Oblon, Spivak, McClelland, Maier & Neustadt

[57] ABSTRACT

In a pump housing are installed a pair of pump rotors which rotate as one body with a rotating shaft. A plurality of vanes are mounted on these pump rotors to separate the internal space of each cam ring into a plurality of pump chambers. An intermediate side plate is positioned between the cam rings, which are held between one wall of the pump housing and a rear side plate. The intermediate side plate is constituted of a pair of side plates which are in contact with each other. A recess is formed in the inner peripheral part of one of the opposite sides of these side plates, forming a pressure chamber. A pressure fluid discharged from the pump chamber is supplied into this pressure chamber. The inner peripheral part of each side plate is elastically deflected by the fluid pressure of the pressure chamber into contact with the side of each pump rotor. Thus, gaps between the side plates and each pump rotor are narrowed, preventing fluid leaks.

4 Claims, 3 Drawing Sheets

TANDEM ROTARY PUMP WITH PRESSURE CHAMBER BETWEEN TWO INTERMEDIATE SIDE PLATES

BACKGROUND OF THE INVENTION

1. Field of the Invention

The present invention relates to a tandem pump having a pair of pump rotors in a hollow chamber of a pump housing.

2. Description of the Prior Art

A conventional tandem pump of this type, as illustrated in FIG. 5, is provided with a first cam ring 3, an intermediate side plate 4, a second cam ring 5, and a rear side plate 6 which are disposed side by side in order, and inserted in a hollow chamber 2 of a pump housing 1. Within the first cam ring 3 is rotatably disposed a first rotor 7 and within the second cam ring 5 is rotatably disposed a second rotor 8.

Between the rear side plate 6 and the end wall of the pump housing 1 are formed first and second fluid chambers 9*a* and 9*b*. The rear side plate 6 is pressed toward the second cam ring 5 and the second rotor 8 by means of a fluid presure of a fluid led into the first and second fluid chambers 9*a* and 9*b*. Furthermore, the intermediate side plate 4 is pressed toward the first cam ring 3 and the first rotor 7 and, at the same time, the rear side plate 6 is elastically deflected at the central part toward the second rotor side in order to reduce a gap, thereby preventing oil leaks from the sliding contact part.

In a conventional tandem pump of such a constitution, however, the inner peripheral part of the intermediate side plate 4 can not be elastically deflected, depending upon the fluid pressure of the discharge fluid led into the first and second fluid chambers 9*a* and 9*b*. Accordingly, oil leaks through a gap between this intermediate side plate 4 and the first and second rotors 7 and 8 can not reliably be prevented, resulting in such a problem as poor volumetric efficiency.

An accessory drive mechanism having a separator plate in contact with a pump rotor and a motor rotor has been disclosed in U.S. Pat. No. 3,104,530, and a hydraulic pump having a pressure plate in contact with a pump rotor has been disclosed in U.S. Pat. No. 4,347,047.

SUMMARY OF THE INVENTION

It is an ojbect of the present invention to provide a tandem pump of good delivery efficiency wherein oil leaks between an intermediate side plate and a first and a second rotor can be prevented reliably.

It is another object of the present invention to provide a tandem pump in which the intermediate side plate is constituted of a pair of side plates which are in contact with each other forming a pressure chamber to supply a pressure fluid between these side plates. Each of the side plates is elastically deflected by the pressure in the pressure chamber, into close contact with the first and second rotors, thereby reliably preventing oil leaks.

The tandem pump comprises a pump housing in which a hollow chamber is formed; a rotating shaft rotatably supported in the pump housing and positioned at one end in the hollow chamber; and first and second rotors which are axially movably connected in two places in the axial direction on one end of the rotating shaft and rotate as one body.

One side wall of the first rotor is in contact with one of the chamber walls of the hollow chamber.

The rotors are each provided with vanes radially extending outwardly with rotation, at a plurality of positions in the circumferential direction on the outer peripheral surface.

First and second cam rings are so disposed that a cam face formed on the inner periphery faces the outer peripheral surface of each of the rotors, drawing a fluid into the inside space defined by the vanes extending outwardly and delivering an increased pressure.

One side of the first cam ring is in contact with one of walls of the hollow chamber.

Between the first cam ring and the second cam ring is positioned an intermediate side plate movable in the axial direction of the rotating shaft. The intermediate side plate is constituted of first and second side plates which are in contact with each other on their one side. The other side of the first side plate is in contact with the other side of the first rotor and the first cam ring, while the other side of the second plate is in contact with one side of the second rotor and the second side plate.

In the inner peripheral surface of at least one of the first and the second side plate, a recess serving as a pressure chamber is formed.

A rear side plate is mounted movable in the axial direction of the rotating shaft, in contact with the other side of the second cam ring and the second rotor, forming an enclosed fluid chamber between the rear side plate and the other wall of the hollow chamber.

A fluid port is provided to lead a part of the pressure fluid discharge from either of the first and second cam rings into the pressure chamber. A part of the pressure fluid discharged from at least one of the first and second cam rings is led into the fluid chamber through a fluid port.

In the tandem pump of the above-described constitution, the rear side plate presses the first and second rotors and the intermediate side plate against one of the chamber walls with a pressure fluid led into the fluid chamber. In this state, the pressure fluid is introduced into the pressure chamber between the first and second side plates which constitute the intermediate side plate, thus elastically deflecting the inner peripheral part of the first side plate toward the first rotor, and the inner peripheral part of the second side plate toward the second rotor.

The elastic deflection of these side plates decreases a gap between the first side plate and the first rotor and a gap between the second side plate and the second rotor, preventing oil leaks through the gaps.

DESCRIPTION OF THE PREFERRED EMBODIMENT

Figure 1:
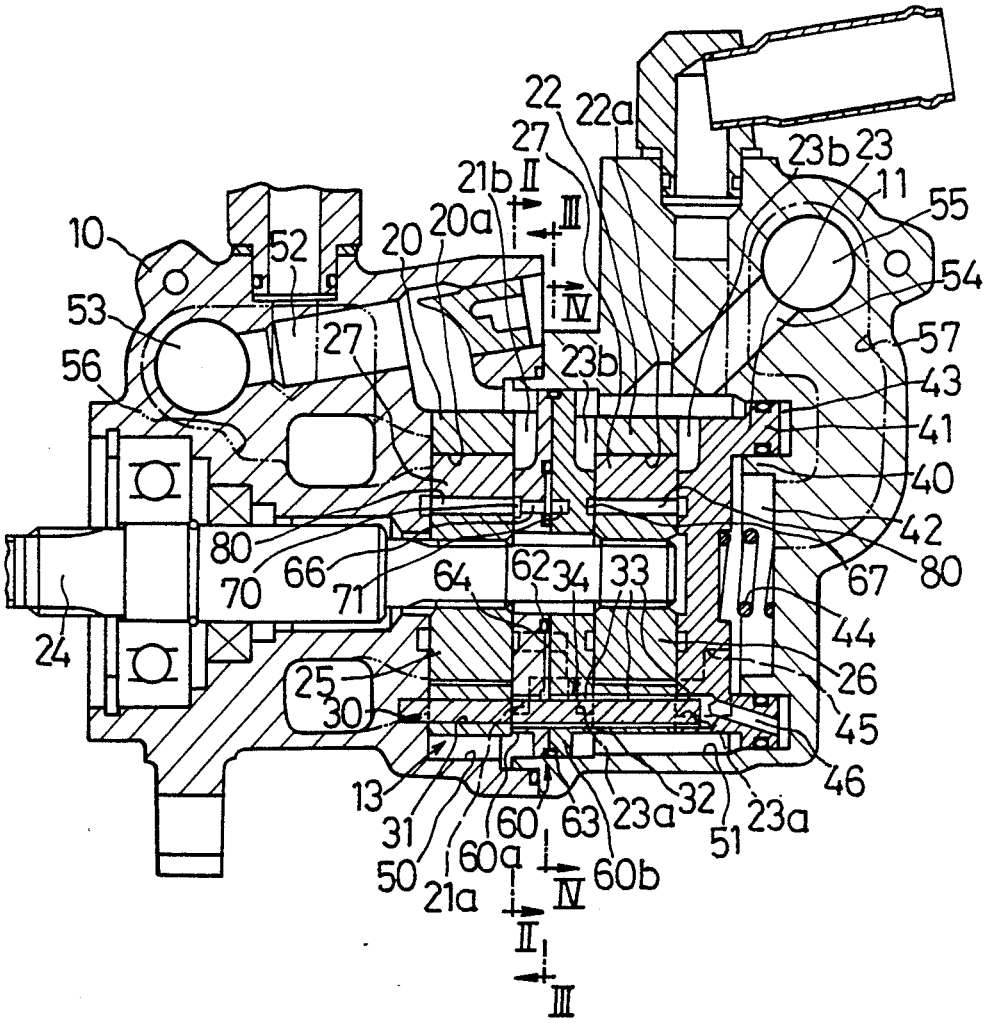
FIG. 1 is a longitudinal sectional view of a tandem pump, the pump section of which is taken along section line I—I of FIG. 2.

Hereinafter a preferred embodiment of the present invention will be described with reference to FIGS. 1, 2 and 3. Numeral 10 denotes a first pump housing, and numeral 11 indicates a second pump housing connected to the first pump housing 10. In the first pump housing 10 and the second pump housing 11 is formed a hollow chamber 13 of a circular section. In this hollow chamber 13 are inserted a first cam ring 20, an intermediate side plate 60, a second cam ring 22, and a rear side plate 23, which are disposed side by side in order of mention.

In the first pump housing 10, a rotating shaft 24 is rotatably supported, with its one end positioned in the hollow chamber 13. On one end of the rotating shaft 24 are mounted a first rotor 25 by splines in a position corresponding to the first cam ring 20, and a second rotor 26 also by splines in a position corresponding to the second cam ring 22. On the outer peripheral surface of the first rotor 25 and the second rotor 26 are formed containing chambers 80 in a plurality of circumferential positions. Within each containing chamber 80 are disposed vanes 27 outwardly movable in the radial direction. On the inner periphery of the first and second cam rings 20 and 22 are formed cam faces 20*a* and 22*a* of elliptical section with which the edges of the vanes 27 moving outwardly with the rotation of the rotors 25 and 26 are in contact.

The intermediate side plate 60 is constituted of first and second side plates 60*a* and 60*b* which are in contact with each other at the outer peripheral part. This first side plate 60*a* has, in the surface on the first rotor 25 side, a discharge port 21*a*, a suction port 21*b*, and a back pressure groove 70 formed as illustrated in FIG. 2. In the surface of the second side plate 60*b* on the second rotor 26 side, a discharge port 23*a* and a suction port 23*b* and a back pressure groove 67 are formed. These back pressure grooves 67 and 70 communicate with the containing chambers 80.

Figure 2:
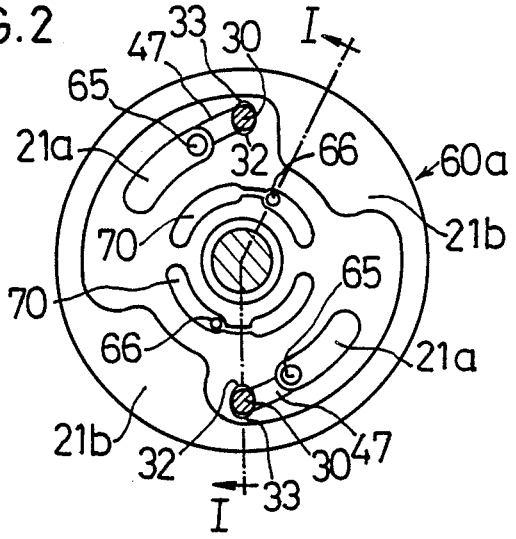
FIG. 2 is a sectional view taken along section line II—II in FIG. 1.
Figure 3:
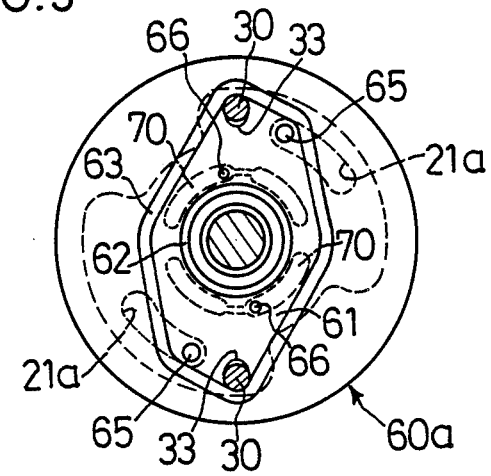
FIG. 3 is a sectional view taken along section line III—III in FIG. 1.
Figure 4:
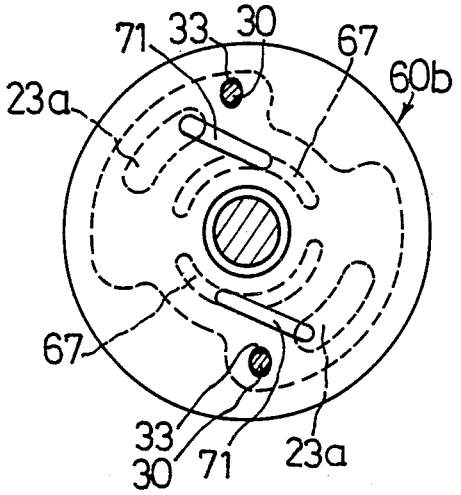
FIG. 4 is a sectional view taken along section line IV—IV in FIG. 1.
Figure 5:
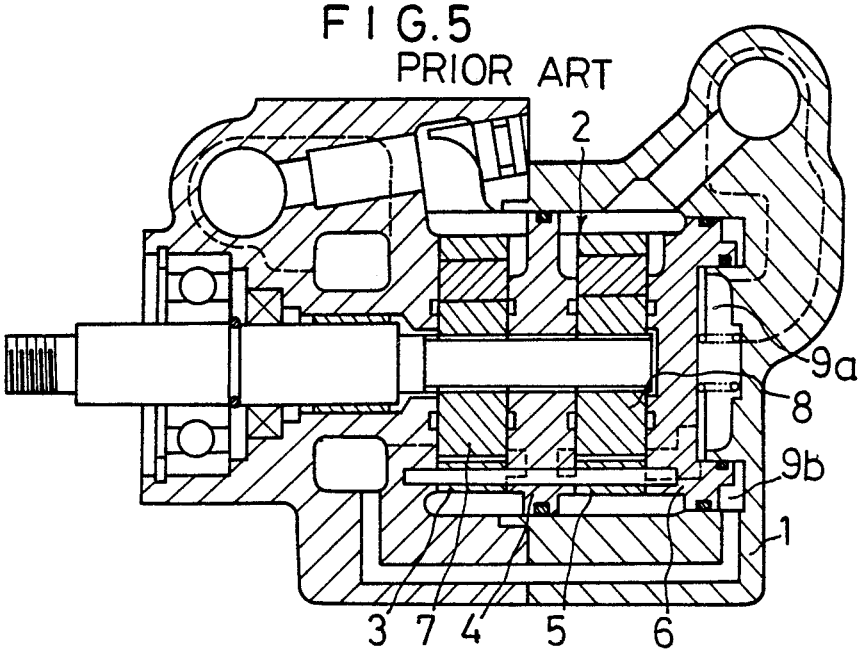
FIG. 5 PRIOR ART
FIG. 5 is a longitudinal sectional view of a conventional tandem pump.

In the inner peripheral part of the surface of the first side plate 60*a* which is opposite to the second side plate 60*b*, a recess 61 is formed as shown in FIG. 3. This recess 61 has a nearly rhombic form. On the outer periphral edge and in the inner peripheral edge are disposed O-rings 62 and 63, forming an enclosed pressure chamber 64 (FIG. 1) between the recess 61 and the second side plate 60*b*. This pressure chamber 64 communicates with the discharge port 21*a* through a first through hole 65 (FIGS. 2 and 3) formed in parallel with the axis of the rotating shaft 24, and also with the back pressure groove 70 through a second through hole 66 formed in parallel with the axis of the rotating shaft 24. In the surface of the second side plate 60*b* (FIG. 4) with which the first side plate 60*a* is in contact, is formed a groove 71 communicating with the first through hole 65 and the second through hole 66.

In FIG. 1, a couple of pins 30 (only one pin is shown) are fixedly fitted in the first pump housing 10, in parallel with the rotating shaft 24. These pins 30 are inserted through a hole 31 in the first cam ring 20 and a hole 32 formed through in the intermediate side plate 60, the second cam ring 22 and the rear side plate 23, thereby supporting the first cam ring 20 and the second cam ring 22 in a specific phase to the first pump housing 10 through the pins 30. The hole 32 is formed in an elliptical form. Between this hole 32 and the pins 30, gaps 33 are defined in the radial direction, forming a first connecting passage 34 connecting the discharge port 21*a* with a second fluid chamber 43 described later.

On the end wall opposite to the rear side plate 23 of the second pump housing 11 is formed a cylindrical projection 40. On the end of the rear side plate 23 disposed opposite thereto is formed a projection 41 which fits over the outer periphery of the projection 40. By these projections 40 and 41 are formed a first fluid chamber 42 and the second fluid chamber 43 defined between the rear side plate 23 and the end wall of the pump housing 11. A spring 44 which presses the rear side plate 23 toward the second rotor 26 side is provided inside the first fluid chamber 42. This first fluid chamber 42 communicates with the discharge port 23*a* through a third connecting passage 45 formed in the rear side plate 23. The second fluid chamber 43 is connected with the first connecting passage 34 through a second connecting passage 46 formed in the rear side plate 23. One end of the first connecting passage 34 is connected to the discharge port 21*a* through a connecting groove 47 (see FIG. 2) formed in the surface of the first side plate 60*a* on the first rotor 25 side.

Between the inner periphery of the hollow chamber 13 and the outer periphery of the first cam ring 20 and the second cam ring 22 are formed a first annular groove 50 and a second annular groove 51 connected to the respective suction ports 21*b* and 23*b*. The first annular groove 50 is connected to a first flow control valve 53 through a suction passage 52 formed in the first pump housing 10, while the second annular groove 51 is connected to a second flow control valve 55 through a suction passage 54 formed in the second pump housing 11. The discharge port 21*a* is connected to the first flow control valve 53 through a discharge passage 56 formed in the first pump housing 10, while the discharge port 23*a* is connected to the second fluid control valve 55 through a discharge passage 57 formed in the second pump housing 11. The fluid controlled by the first fluid control valve 53 and the second flow control valve 55 is supplied to respective different fluid equipment.

The first and second side plates 60*a* and 60*b* and the rear side plate 23 are movable in the axial direction of the rotating shaft 24.

Next, the operation of the tandem pump will be explained. With the rotation of the rotating shaft 24, the first and second rotors 25 and 26 rotate together, and the vanes 27 move toward the cam faces 20*a* and 22*a* of the first cam ring 20 and the second cam ring 22 while rotating. The vanes 27 come into contact, at their edges, with the cam faces 20*a* and 22*a* to define the internal space of the first cam ring 20 and the second cam ring 22, thus forming a plurality of pump chambers. The volume of each of these pump chambers varies with the rotation of the rotors 25 and 26, drawing the fluid out from the suction port 21*b* and 23*b* and, after increasing its pressure, discharging the fluid to the discharge ports 21*a* and 23*a*. The fluid discharged to the discharge port 21*a* is then set to the fluid equipment through the discharge passage 56 and the first flow control valve 53, while the fluid discharged to the discharge port 23*a* is set to the fluid equipment different from that on the first flow control valve 53 side through the discharge passage 57 and the second flow control valve 55.

The fluid pressure differs between the discharge port 21*a* and the discharge port 23*a* with the operating conditions of the fluid equipment; a part of the pressure fluid in the discharge port 21*a* is let into the second fluid chamber 43 through the first connecting passage 34 and the second connecting passage 46, while a part of the pressure fluid in the discharge port 23*a* is led into the first fluid chamber 42 through the third connecting passage 45. Consequently, the rear side plate 23 is applied with the fluid pressure supplied to the first fluid chamber 42 and the second fluid chamber 43, and the rear side plate 23 is pressed toward the second cam ring 22, being elastically deflected at the center toward the second rotor 26. Thus, the gap between the second rotor 26 and the rear side plate 23 decreases to prevent fluid leaks.

At this time, the other part of the pressure fluid in the discharge port 21*a* is supplied to the pressure chamber 64 through the first through hole 65, the fluid pressure thus elastically deflecting the inner peripheral part of the first side plate 60*a* toward the first rotor 25 and also the inner peripheral part of the second side plate 60*b* toward the second rotor 26. Consequently, the gaps between the first side plate 60*a* and the first rotor 25 and between the second side plates 60*b* and the second rotor 26 are narrowed to prevent fluid leaks, thereby enabling the pump to discharge a high-pressure fluid with a good efficiency.

The pressure fluid supplied to the pressure chamber 64 through the first through hole 65 is supplied to the first back pressure chamber 70 from the introducing groove 71 through the second through hole 66. The pressure fluid applied to the first back pressure chamber 70 is led to the containing chambers 80. This results in an outwardly directed pressure exerted on an inner peripheral surface of the vane 27 to ensure the sliding contact of the edge of the vane 27 to the cam face 20*a* of the first cam ring 20.

The intermediate side plate 60 and the rear side plate 23 mentioned above are both sintered parts; since the first and second through holes 65 and 66 of the first side plate 60*a* and the introducing groove 71 of the second side plate 60*b* are integrally formed with these side plates 60*a* and 60*b*, manufacturing costs can be decreased.

In the above-described embodiment the first connecting passage 34 is formed of the elliptical hole 32 and the circular pin 30; but the first connecting passage 34 may be formed by making a longitudinal cutout in a part of the outer periphery of the circular pin 30. In this case, the hole 32 may be made in a circular form.

Furthermore, in the above-described embodiment the pressure fluid is supplied to the pressure chamber 64 through the discharge port 21*a*, but may be supplied through the discharge port 23*a*.

Accordingly to the present invention, as described above, the intermediate side plate 60 is constituted of the first and second side plates 60*a* and 60*b*, and the high-pressure fluid is introduced into the pressure chamber 64 formed between these first and second side plates 60*a* and 60*b*. Therefore, exerting this fluid pressure can elastically deflect the inner peripheral part of the first and second side plates 60*a* and 60*b* toward the first and second rotors 25 and 26 respectively, thereby reducing the gaps to decrease oil leaks through these gaps and accordingly improving the volumetric efficiency.

Because the first through hole 65 connecting the pressure chamber 64 to the discharge port 21*a* and the second through passage 66 connecting the pressure chamber 64 to the back pressure groove 70 are vertically formed in the surface of the first side plate 60*a*, the first through hole 65 and the second through hole 66 can easily be formed at the time of sinter moulding of the first side plate.

Furthermore, because the introducing groove 71 connecting between the first and second through holes 65 and 66 is formed in the surface of the second side plate 60*b* facing the pressure chamber 64, it is possible to supply to the back pressure groove 70 a pressure fluid enough to push the vanes 27 upwardly if fluid viscosity increases in a cold season.

What is claimed is:

1. A tandem pump, comprising:

a pump housing in which a hollow chamber, first and second suction passages and first and second discharge passages are formed, said first and second discharge passages communicating with respective different fluid equipment;

a rotating shaft rotatably supported in said pump housing and positioned at one end in said hollow chamber;

first and second rotors which are axially movably connected in two places in the axial direction on one end of said rotating shaft and rotatable as one body; one side wall of said first rotor being in contact with one of said walls of said hollow chamber; said rotors being each provided with vanes radially moving outward with rotation within respective containing chambers formed at a plurality of positions in the circumferential direction on the outer peripheral surface of said rotors;

first and second cam rings which are so disposed that a cam face formed on the inner pheriphery faces the outer peripheral surface of each of said rotors, drawing a fluid from respective suction passages into an inside space defined by said vanes moving outwardly and delivering an increased pressure to respective discharge passages, and one side of said first cam ring being in contact with one of said walls of said hollow chamber;

an intermediate side plate movable in the axial direction of said rotating shaft which is positioned between said first cam ring said second cam ring, said intermediate side plate being constituted of first and second side plates which are in contact with each other on their one side, and the other side of said first side plate being contact with the other side of said first rotor and said first cam ring, while the other side of said second side plate being in contact with one side of said second rotor and said second cam ring; and a recess serving as a pressure chamber which is formed in the inner peripheral surface of at least one of said one sides of said first and second side plates;

a rear side plate which is mounted movable in the axial direction of said rotating shaft, in contact with the other side of said second cam ring and said second rotor, forming enclosed first and second fluid chambers between said rear side plate and the other wall of said hollow chamber;

a first fluid introducing passage which leads a part of the pressure fluid discharged from one of said first and second cam rings into said pressure chamber;

a second fluid introducing passage which leads a part of the pressure fluid discharged from said first cam ring into said first fluid chamber; and a third fluid introducing passage which leads a part of the pressure fluid discharged from said second cam ring into said second fluid chamber.

2. A tandem pump as claimed in claim 1, wherein a first through hole as said first fluid introducing passage and a second through hole are formed in one side plate out of said first and second side plates at locations within said pressure chamber so as to be perpendicular to a surface of said one side plate, said first through hole connects a discharge port formed in the other surface of said one side plate to said pressure chamber, said second through hole is formed at a location different from that on said first through hole, connects said pressure chamber to a back pressure groove formed in the other surface of said one side plate and communicates with said containing chambers formed in one of said rotors whereby a part of pressure fluid in said pressure chamber is led to said containing chambers.

3. A tandem pump as claimed in claim 2, wherein the other side plate out of said first and second side plates, which is not provided with said first and second through hole, is provided with an introducing groove in a surface facing said pressure chamber, and said introducing groove connects a portion facing said first through hole to a portion facing said second through hole.

4. A tandem pump as claimed in claim 1, wherein said second fluid introducing passages is composed of elliptical holes formed in said intermediate side plates, second cam ring and said rear side plates in which a pin is inserted in order to prevent relative rotational movements among said intermediate side plates, second cam ring and rear side plate, and through which a part of pressure fluid in said pressure chamber is led to said first fluid chamber.

* * * * *